United States Patent [19]

Sykes

[11] Patent Number: 5,050,829

[45] Date of Patent: Sep. 24, 1991

[54] SUPPORTING ASSEMBLY

[76] Inventor: Christopher C. Sykes, 211 Queens Quay West, Apartment 902, Toronto, Ontario, Canada, M5J 2M6

[21] Appl. No.: 588,856

[22] Filed: Sep. 27, 1990

[51] Int. Cl.[5] ..... F16M 11/16

[52] U.S. Cl. ..... 248/188.8; 108/153; 248/188.4; 248/223.4

[58] Field of Search ..... 248/188.8, 188.4, 188.1, 248/188, 223.4, 224.2, 224.4; 256/59, 65, DIG. 5; 108/153, 111

[56] References Cited

U.S. PATENT DOCUMENTS

| | | | |
|---|---|---|---|
| 1,858,381 | 5/1932 | Vance | 248/188.8 |
| 2,714,540 | 8/1955 | Diehm . | |
| 3,639,001 | 2/1972 | Anderson | 248/188.8 X |
| 3,747,885 | 7/1973 | Ciancimino . | |
| 3,796,169 | 3/1974 | Bales et al. | 248/188.8 X |
| 4,014,520 | 3/1977 | Walters . | |
| 4,557,091 | 12/1985 | Auer . | |
| 4,593,874 | 6/1986 | Dunagan | 248/188.4 |
| 4,667,605 | 5/1987 | Bastian . | |
| 4,700,915 | 10/1987 | Killian . | |
| 4,746,088 | 5/1988 | Kruger | 248/188.8 |
| 4,760,802 | 4/1988 | Leong | 248/188.1 X |
| 4,799,735 | 1/1989 | Meyer . | |
| 4,807,838 | 2/1989 | Anderson | 248/188.8 X |
| 4,884,513 | 12/1989 | Newhouse et al. | 108/153 X |
| 4,895,332 | 1/1990 | Hansen et al. | 256/59 X |

*Primary Examiner*—Ramon O. Ramirez
*Attorney, Agent, or Firm*—Ridout & Maybee

[57] ABSTRACT

The invention relates to a supporting assembly for example for a table, bench or chair leg. The supporting assembly essentially comprises two identical halves extruded from extrudable materials so that the supporting assembly can be simply extruded through one extrusion mould. Each half also provides means integrally extruded therewith for interfitting with the other and for connecting horizontal plates which are to be attached to a supported object such as a table top so that the supporting assembly has an aesthetically pleasing appearance and can be made without welding.

7 Claims, 3 Drawing Sheets

SUPPORTING ASSEMBLY

BACKGROUND OF THE INVENTION

The invention relates to a supporting assembly for example for a table, bench or chair leg.

Supporting assemblies such as table legs are often formed from metal tubing, one end of which is welded to a plate through which holes are made to allow the plate to be attached with screws or other fasteners to the underside of the table. The operation of welding a tube to a plate is, however, time consuming and expensive. The welding operation is difficult to control and as a result the quality and the strength of the welded connection are often poor. Moreover, the rough weld bead is aesthetically unattractive and may present rough or sharp edges which can damage materials brought into contact with the weld or can injure the fingers of those handling the welded part.

It is an object of the present invention to provide a supporting assembly whereby the above and other drawbacks of the known assemblies are avoided.

SUMMARY OF THE INVENTION

According to the invention a supporting assembly comprises two identical generally channel section extruded halves which are interfitted and form an elongated hollow body, the ends of which provide means integrally extruded with each half for connecting horizontal plates.

In order to interfit the two identical generally channel section extruded halves and form an elongated hollow body, the supporting assembly may be designed in a way that each extruded half comprises a groove spaced inwardly from an outer end of one channel side and a tongue interfitting with the groove of the other half and spaced inwardly the same distance from the outer end of the channel side, opposite said one side whereby the outer sides of the halves are co-planar when interfitted together.

The means for connecting horizontal plates may comprise screw bosses integrally extruded with each said half, each screw boss comprising a pair of arcuate arms having a gap between their ends facing toward the interior of the channel and defining a circular opening with raised portions spaced around the circumference of said opening capable of being engaged by the threads of a self-tapping screw.

Each half of the assembly also may have an integrally extruded flange extending inwardly from each channel side and in combination therewith a clamp inserted in one end of the assembly and having clamp plates compressively engaging outer sides of said flanges.

The uses of the supporting assembly in accordance with the invention are quite general. The assembly may be used, for example, as a table leg, particularly for various peninsula tables used with workstations in an office environment. In addition, it may be used as a supporting leg for a bench, a chair and the like. It may be used as a supporting assembly in other furniture or non-furniture applications.

The invention will be more clearly understood by reference to the accompanying drawings illustrating by way of example one embodiment thereof.

DESCRIPTION OF THE PREFERRED EMBODIMENT

Figure 1:
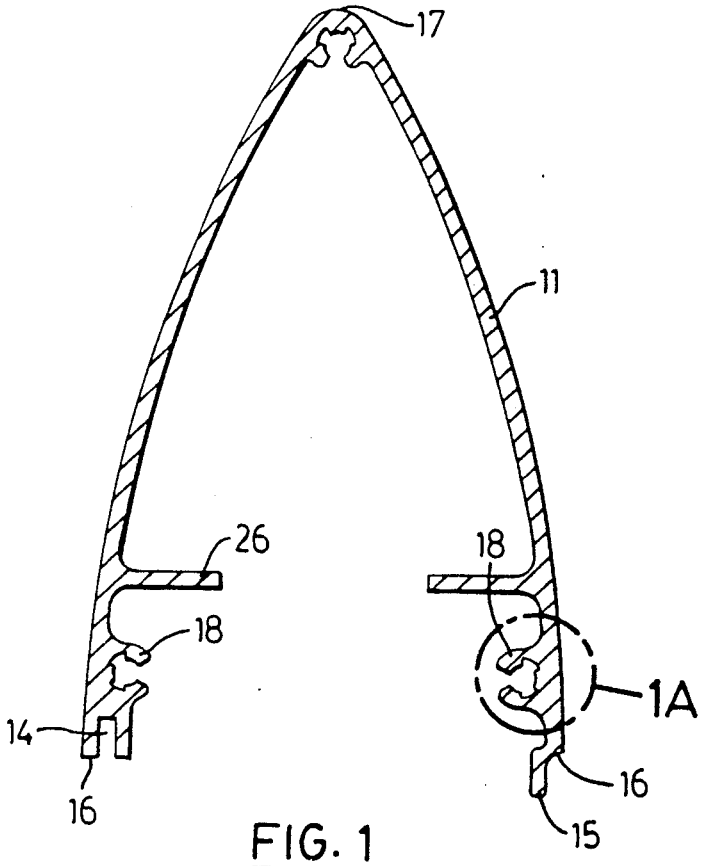
FIG. 1 is a sectional view of a half of a supporting assembly.
Figure 2:
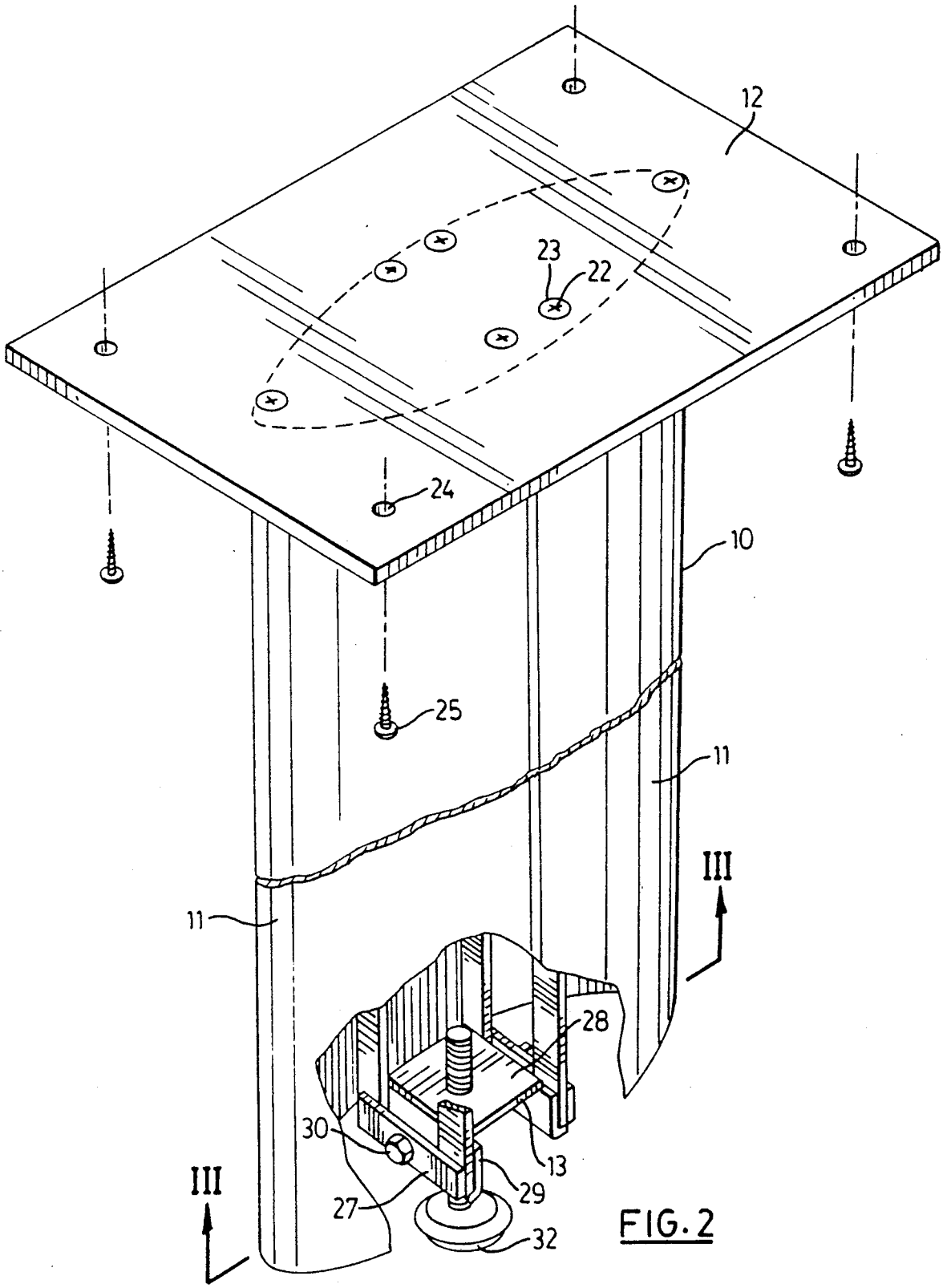
FIG. 2 a perspective view of a supporting assembly.
Figure 3:
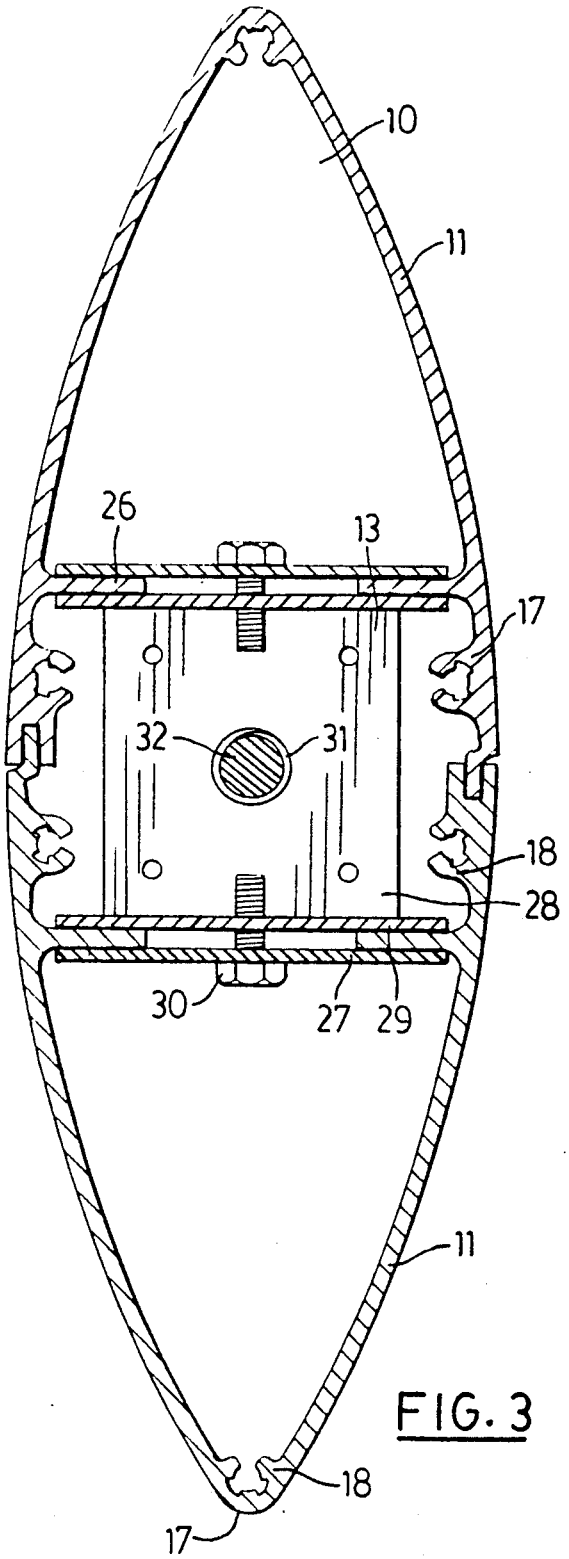
FIG. 3 is an enlarged sectional view in the direction of arrow III of FIG. 2.

As appears in FIG. 1, FIG. 2 and FIG. 3, the supporting assembly basically comprises an elongated hollow body 10 formed by two identical channel section extruded halves 11 which are interfitted, a horizontal plate 12 attached to the top end of the hollow body 10, and a clamp 13 at the bottom end of the hollow body 10.

Each extruded half 11 is preferably made from aluminum or other extrudable metal. It may, however be extruded from other high strength material, for example high strength plastic and comprises a groove 14 spaced inwardly from an outer end of one channel side and a tongue 15 interfitting with the groove 14 of the other half and spaced inwardly the same distance from the outer end of the channel side opposite said one side, whereby the outer sides of the halves 11 are co-planar when interfitted together. As will be appreciated the halves 11 are obtained as equal predetermined lengths severed from a common extrusion having the cross-section seen in FIG. 1. The end of each channel side, between the adjacent outer side of the channel and the groove 14 and the tongue 15, respectively, comprises a face 16 extending perpendicular to said adjacent outer side of the channel, so that the halves 11 can be perfectly interfitted together.

Figure 1A:
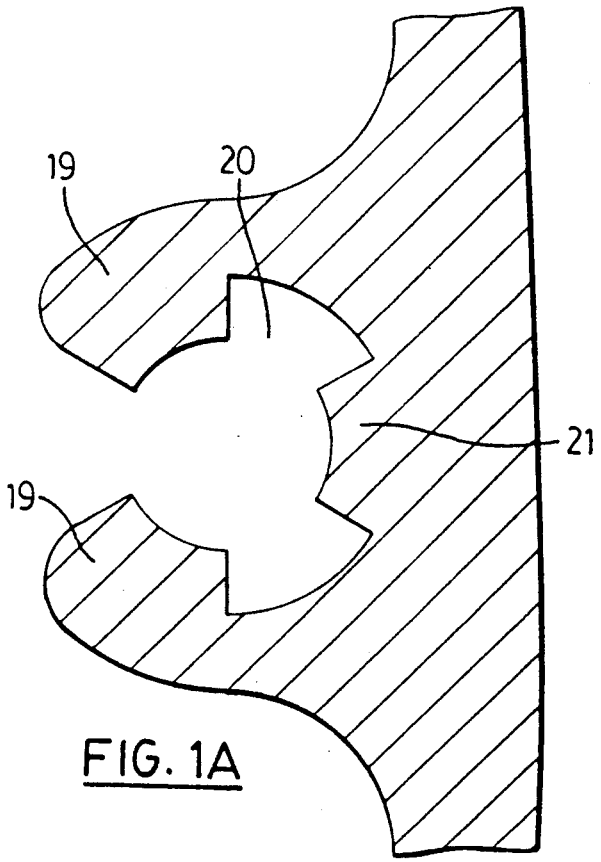
FIG. 1A is an enlarged sectional view of detail 1A in FIG. 1.

Each half 11 narrows toward an apex 17 at the bottom of the channel and is provided with three screw bosses 18 integrally extruded therewith, which are adjacent the apex 17 and the end of each channel side respectively. Each screw boss 18 comprise a pair of arcuate arms 19, shown in FIG. 1A, having a gap between their ends facing toward the interior of the channel and defining a circular opening 20 with raised portions 21 spaced around the circumference of the opening 20 capable of being engaged by the threads of a self-tapping screw.

The horizontal plate 12 is attached by passing self-tapping screws 22 through apertures 23 drilled through the plate 12, the screws 22 engaging in the screw bosses 18 at the top end of the hollow body 10. The plate 12 is formed with holes 24 adjacent the circumference of the plate 12, which allow the plate 12 with the body 10 to be attached to the underside of an object to be supported, for example a table top, with screws or other fasteners 25, passed upwardly through the holes 24.

Each half 11 has an integrally extruded flange 26 extending inwardly from each channel side which can be used to connect the two halves 11 together with the clamp 13. When the clamp 13 is inserted in the lower end of the hollow body, two clamp plates 27 compressively engage outer sides of the flanges 26. Meanwhile, a central member 28, having edge flanges 29, engages snugly on the inner sides of the extruded flanges 26. An engaging force is exerted by a clamp screw 30 engaging a respective clamp plate 27, through a hole drilled through the clamp plate 27, and threaded in a threaded opening in each edge flange 29 of the central member 28. The central member 28 also provides a threaded aperture 31 therethrough threadedly receiving a level adjusting screw 32 having its head disposed outwardly from the end of the supporting assembly. By means of the adjusting screw 31 the length of the supporting assembly can be adjusted to allow for levelling of the object being supported, such as the plane of a table top.

I claim:

1. A supporting assembly comprising two identical generally channel section extruded halves which are interfitted and form an elongated hollow body the ends of which provide means integrally extruded with each half for connecting horizontal plates, and in which said means for connecting horizontal plates comprise screw bosses integrally extruded with each said half, each screw boss comprising a pair of arcuate arms having a gap between their ends facing toward the interior of the channel and defining a circular opening with raised portions spaced around the circumference of said opening capable of being engaged by the threads of a self-tapping screw.

2. A supporting assembly as claimed in claim 1 wherein each extruded half comprises a groove spaced inwardly from an outer end of one channel side and a tongue interfitting with the groove of the other half and spaced inwardly the same distance from the outer end of the channel side opposite said one side, whereby the outer sides of the halves are co-planar when interfitted together.

3. A supporting assembly as claimed in claim 2 wherein the end of each channel side, between the adjacent outer side of the channel and the tongue and the groove, respectively, comprises a face extending perpendicular to said adjacent outer side of the channel.

4. A supporting assembly as claimed in claim 1 wherein each half narrows toward an apex at the bottom of the channel and has one said screw boss adjacent the apex and one said screw boss adjacent the end of each channel side.

5. A supporting assembly as claimed in claim 1 including a horizontal plate formed with apertures allowing the plate to be attached to said hollow body with self-tapping screws passed downwardly therethrough and engaging in said screw bosses at the top end of said hollow body, and holes allowing the plate with said hollow body to be attached to the underside of an object to be supported with fasteners passed upwardly therethrough.

6. A supporting assembly comprising two identical generally channel section extruded halves which are interfitted and form an elongated hollow body the ends of which provide means integrally extruded with each half for connecting horizontal plates, and wherein each said half has an integrally extruded flange extending inwardly form each channel side and in combination therewith a clamp inserted in the lower end of said hollow body and having clamp plates compressively engaging outer sides of said flanges.

7. A supporting assembly as claimed in claim 6 wherein said clamp comprises a central member having edge flanges engaging the inner sides of said extruded flanges, each edge flange having a threaded opening therein, a clamp screw engaging a respective clamp plate and threaded in said threaded opening, and a threaded aperture in said central member threadedly receiving a level adjusting screw having its head disposed outwardly from the end of the supporting assembly.

* * * * *